US008464390B2

(12) United States Patent
Jones

(10) Patent No.: US 8,464,390 B2
(45) Date of Patent: Jun. 18, 2013

(54) CLEANING GLOVE WITH AGITATING FEATURE

(76) Inventor: Samuel S. Jones, Greenwood, IN (US)

( * ) Notice: Subject to any disclaimer, the term of this patent is extended or adjusted under 35 U.S.C. 154(b) by 239 days.

(21) Appl. No.: 12/821,347

(22) Filed: Jun. 23, 2010

(65) Prior Publication Data

US 2011/0314625 A1 Dec. 29, 2011

(51) Int. Cl.

| | |
|---|---|
| ***A47K 7/02*** | (2006.01) |
| ***A47L 1/06*** | (2006.01) |
| ***A47L 13/10*** | (2006.01) |
| ***A47L 17/08*** | (2006.01) |
| ***A47L 23/04*** | (2006.01) |
| ***A47L 25/00*** | (2006.01) |
| ***A47L 13/00*** | (2006.01) |
| ***B43L 21/00*** | (2006.01) |
| ***E04F 21/16*** | (2006.01) |
| ***A41D 19/00*** | (2006.01) |
| ***A41D 19/01*** | (2006.01) |

(52) U.S. Cl.

USPC ..... 15/227; 15/210.1; 15/118; 2/159; 2/161.6; 2/161.8; 2/158

(58) Field of Classification Search

USPC ..... 15/227, 229.4, 229.8, 208, 114, 210.1, 15/244.3, 118, 209.1, 229.11, 104.93, 104.94, 15/244.1; 2/167, 161.8, 16, 20, 161.6, 161.7, 2/158, 159, 160, 907, 163, 169, 161.3; 428/88, 428/89, 90, 91, 92, 93, 97; 119/611, 612, 119/620, 625; D2/619, 620, 622, 623; D29/113, D29/117.2, 118, 123

See application file for complete search history.

(56) References Cited

U.S. PATENT DOCUMENTS

| | | | | | |
|---|---|---|---|---|---|
| 720,640 | A | * | 2/1903 | Torrens | 2/161.8 |
| 1,559,114 | A | * | 10/1925 | Maranville | 15/227 |
| 2,030,494 | A | * | 2/1936 | Bireley et al. | 15/227 |
| 2,710,971 | A | * | 6/1955 | Hall | 2/161.8 |
| 3,038,187 | A | | 6/1962 | Nathanson | |
| 3,181,193 | A | | 5/1965 | Nobles et al. | |
| 3,638,270 | A | | 2/1972 | Schlegel, Jr. et al. | |
| 3,643,386 | A | * | 2/1972 | Grzyll | 451/523 |
| 4,038,787 | A | * | 8/1977 | Bianchi | 451/523 |
| 4,187,575 | A | | 2/1980 | Collins | |
| D268,968 | S | * | 5/1983 | Sami | D29/117.1 |

(Continued)

FOREIGN PATENT DOCUMENTS

| | | |
|---|---|---|
| CA | 736642 | 6/1966 |
| DE | 2 229 188 | 1/1974 |

(Continued)

*Primary Examiner* — Vanitha Elgart

(74) *Attorney, Agent, or Firm* — Woodard, Emhardt, Moriarty, McNett & Henry LLP

(57) ABSTRACT

An absorbant glove having an agitating feature. The glove is formed from a base material which exhibits a high degree of absorbancy. In order to achieve this high degree of absorbancy, the base material preferably exhibits a very large surface area, such as a synthetic lamb's wool. The glove additionally has one or more areas of a rough, bristled material which is efficient at transmitting mechanical forces from movement of the user's hand to the stain. The bristled material is preferably a synthetic fabric, such as that commonly used for indoor/outdoor carpeting. In certain embodiments, one band of bristled material is formed at an angle to a second band of bristled material, wherein the angle is substantially between 20 degrees and 60 degrees. In other embodiments, the angle is substantially between 30 degrees and 45 degrees.

3 Claims, 1 Drawing Sheet

U.S. PATENT DOCUMENTS

| | | | | |
|---|---|---|---|---|
| 5,134,746 | A * | 8/1992 | William | 15/227 |
| 5,179,755 | A * | 1/1993 | Hill, Jr. | 15/160 |
| 5,311,635 | A * | 5/1994 | Moore | 15/244.3 |
| 5,336,543 | A | 8/1994 | Pyle | |
| 5,361,445 | A | 11/1994 | Giallourakis | |
| 5,408,718 | A | 4/1995 | Sandovsky | |
| 5,524,575 | A * | 6/1996 | Lennon | 119/625 |
| 5,525,393 | A * | 6/1996 | Raab | 428/89 |
| 5,591,507 | A | 1/1997 | Jones | |
| 5,682,837 | A * | 11/1997 | Courtney et al. | 119/625 |
| 5,720,048 | A * | 2/1998 | Perez | 2/161.6 |
| 6,016,571 | A * | 1/2000 | Guzman et al. | 2/167 |
| 6,018,837 | A * | 2/2000 | Andreu | 15/118 |
| 6,098,234 | A * | 8/2000 | Jackson, Jr. | 15/118 |
| 6,557,178 | B1 * | 5/2003 | Hoover | 2/161.6 |
| 6,604,244 | B1 * | 8/2003 | Leach | 2/161.6 |
| 6,829,802 | B2 * | 12/2004 | McKenzie | 15/227 |
| 7,033,965 | B2 * | 4/2006 | Takabayashi et al. | 442/381 |
| 7,251,839 | B2 * | 8/2007 | Bell | 2/161.6 |
| 7,546,644 | B2 * | 6/2009 | Bignon et al. | 2/161.6 |
| 7,581,273 | B2 * | 9/2009 | Dobrin et al. | 15/104.94 |
| 7,823,245 | B2 * | 11/2010 | Firouzman | 15/227 |
| 2005/0268422 | A1 * | 12/2005 | Harrison | 15/227 |
| 2006/0185109 | A1 * | 8/2006 | Barton et al. | 15/227 |
| 2006/0272116 | A1 | 12/2006 | Thompson | |
| 2007/0086828 | A1 * | 4/2007 | Stewart | 401/7 |
| 2008/0178366 | A1 * | 7/2008 | Daher | 2/161.6 |
| 2008/0301852 | A1 | 12/2008 | Suran et al. | |
| 2008/0313788 | A1 * | 12/2008 | Yan | 2/158 |
| 2009/0094772 | A1 * | 4/2009 | Lee et al. | 15/244.3 |
| 2009/0210991 | A1 * | 8/2009 | Tutor | 2/161.8 |
| 2009/0249573 | A1 * | 10/2009 | Ruiz | 15/227 |
| 2009/0282606 | A1 * | 11/2009 | Bordella et al. | 2/161.1 |
| 2010/0064465 | A1 * | 3/2010 | Malaska | 15/227 |
| 2010/0218326 | A1 * | 9/2010 | Yamaguchi | 15/227 |
| 2011/0004974 | A1 * | 1/2011 | Firouzman | 2/161.8 |

FOREIGN PATENT DOCUMENTS

| | | |
|---|---|---|
| EP | 0 514 191 B1 | 11/1992 |
| FR | 1126254 | 11/1956 |
| GB | 278945 | 3/1927 |
| GB | 2 192 327 | 1/1988 |
| JP | 6-133893 | 5/1994 |

* cited by examiner

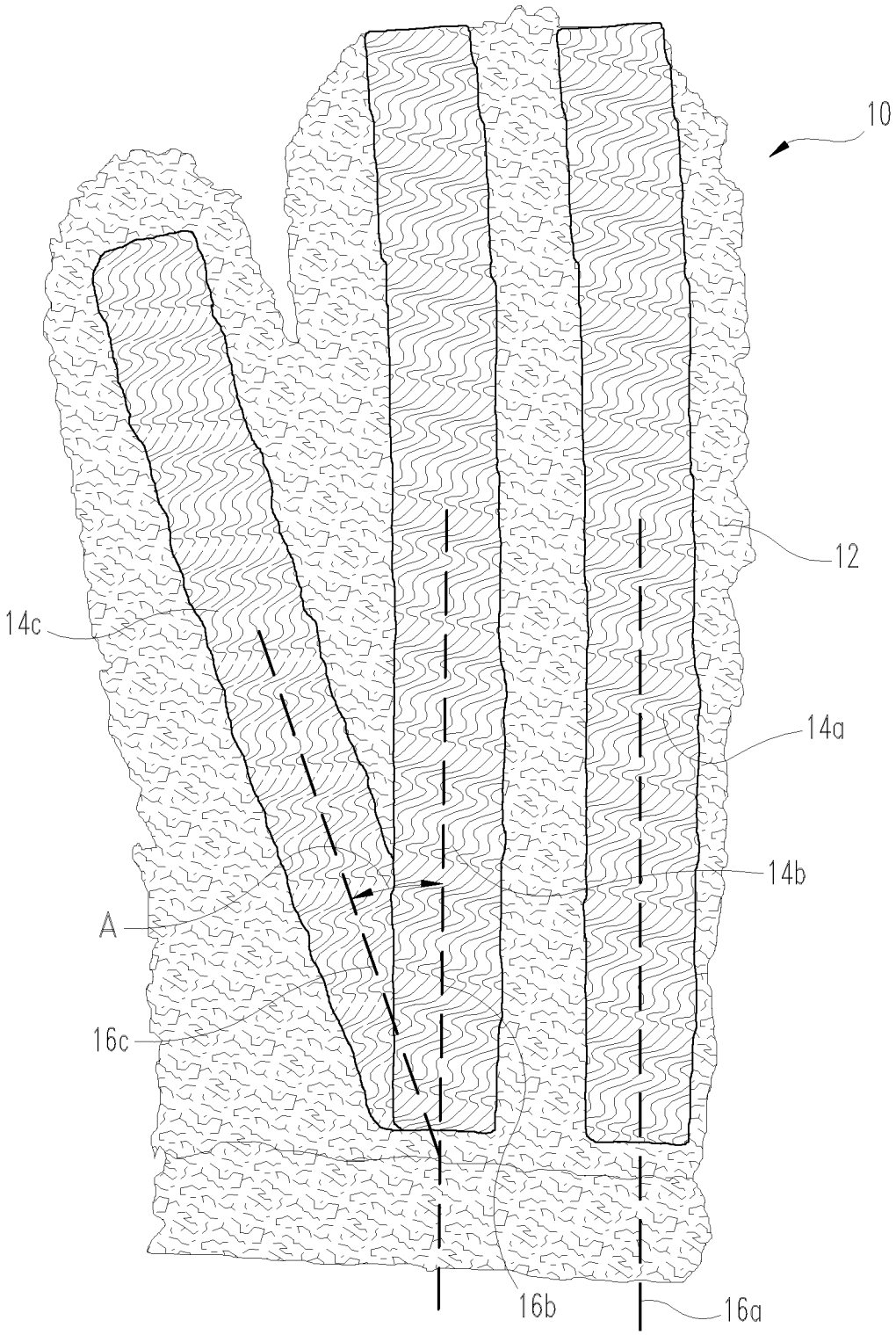
10
12
14c
14a
14b
A
16c
16b
16a

CLEANING GLOVE WITH AGITATING FEATURE

TECHNICAL FIELD OF THE INVENTION

The present invention generally relates to cleaning devices and, more particularly, to a cleaning glove with an agitating feature

BACKGROUND OF THE INVENTION

Most non-professional cleaning is performed by hand, using a cleaning agent (such as a shampoo or a solvent) and some sort of hand held apparatus for applying, working and lifting the cleaning agent. For example, floors, walls, vinyl wallcoverings, upholstered furniture, shower walls and tile, car interiors, etc. are all typically cleaned by hand, as is spot cleaning of carpet stains. Even in professional cleaning applications, hand cleaning methods are used to supplement machine cleaning methods. For example, a carpeted room may be cleaned by any number of professional cleaning devices designed to clean large areas of carpet in minimal time. But even with the use of such cleaning devices, it is usually necessary to clean the awkward areas, such as around the carpet edges or on stairs, by hand.

When cleaning surfaces by hand, it is necessary to apply the cleaning agent to the hand held cleaning apparatus, and to then use the hand held apparatus to apply the cleaning agent to he surface to be cleaned. The hand held apparatus is then used to work the cleaning agent into the surface in order to loosen the dirt or stain therefrom, such as by agitating the hand held apparatus on the surface in the area to be cleaned. This mechanical force acts in conjunction with the chemical action of the cleaning agent to loosen and break the bond between the stain and the surface. Finally, the hand held apparatus is used to lift the loosened dirt as well as the excess cleaning agent from the surface, leaving the surface relatively clean.

There are basically two types of hand held apparatus known in the prior art for hand cleaning: cloths (including sponges) and brushes. Cloths have the advantage that they are absorbant. Because they are capable of absorbing and holding a relatively large quantity of liquid and liquid-born dirt, cloths are well-suited to both applying the cleaning agent to the stain and to lifting the loosened dirt and excess cleaning agent from the surface. However, because of the soft and pliable nature of such cloths, they are relatively inefficient agitating devices for use in working the cleaning agent into the stain.

Brushes, on the other hand, contain many stiff bristles which are very effective at transmitting mechanical forces produced by movement of the user's hand to the surface to be cleaned. This efficient transmission of agitating forces to the stain makes brushes ideal for loosening stains from the surface to be cleaned. However, because of the stiff and straight nature of such brush bristles, they are not very absorbant and therefore relatively inefficient for applying the cleaning agent to the surface or lifting it therefrom.

These different characteristics of cloths and brushes mean that neither of them display all of the desired characteristics of a hand held cleaning apparatus, namely absorbancy and the ability to efficiently transmit mechanical agitation forces to the stain.

My prior U.S. Pat. No. 5,591,507 entitled Absorbant Cloth with Agitating Feature disclosed a device that displayed both desired characteristics. However, there remains a need for devices that improve upon the performance of that device.

SUMMARY OF THE DISCLOSURE

The present disclosure relates to an absorbant cloth glove having an agitating feature. The cloth is formed from a base material which exhibits a high degree of absorbancy. In order to achieve this high degree of absorbency, in certain embodiments the base material preferably exhibits a very large surface area, such as a synthetic lamb's wool. The cloth additionally has one or more areas of a rough, bristled material which is efficient at transmitting mechanical forces from movement of the user's hand to the stain. In certain embodiments, the bristled material is preferably a synthetic fabric, such as that commonly used for indoor/outdoor carpeting. In order to maximize the scrubbing action of the bristled material, the glove has at least one band of bristled material having a first axis. A second band of bristled material is affixed to the glove, the second band having a second axis arranged at an angle to the first axis.

In certain embodiments, an absorbant glove having an agitating feature, comprising a base material of absorbant fleece material, a first band of rough material sewn to a surface of the base material and having a first axis and a second band of rough material sewn to a surface of the base material and having a second axis, wherein said first axis and said second axis form an angle therebetween of substantially between 20 degrees and 60 degrees.

BRIEF DESCRIPTION OF THE DRAWINGS

FIG. 1 is a perspective view of a first embodiment of the present disclosure.

DETAILED DESCRIPTION OF THE DISCLOSURE

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a glove, indicated generally at 10. For the purposes of the present disclosure, the term "glove" is intended to encompass any device that can be worn over a user's hand, whether in the form of a traditional glove or mitten, whether the device includes separate internal spaces for the user's fingers or thumb. The glove 10 is formed from a base material 12 which exhibits a high degree of absorbancy. In general, absorbancy may be created by a material which has a very large surface area, a weave which is adapted to absorbing and holding liquid and/or a material formed from highly absorbant threads. In certain embodiments, the absorbant material 12 is formed from a synthetic lamb's wool, made from 90% polyester and 10% acrylic. It will be appreciated by those skilled in the art that many other types of absorbant material may be substituted for the synthetic lamb's wool (i.e. fleece) used in the preferred embodiment, such as genuine lamb's wool, terry cloth, or woven cotton, to name just a few non-limiting examples.

The absorbant nature of the material 12 makes it ideal for applying the cleaning agent thereto, as the material 12 will readily absorb a relatively large quantity of the cleaning agent and hold it within the material 12. When the glove 10 is then applied to the surface to be cleaned, pressure may be applied to the glove 10 by the user's hand, thereby forcing the cleaning agent from the glove 10 and onto the surface to be cleaned. Furthermore, after agitation of the surface to be cleaned, the absorbant nature of the material 12 may be used to recover the loosened dirt as well as the excess cleaning solution from the surface.

The glove 10 further includes at least one area 14 of a rough, bristled fabric attached to the material 12. In the preferred embodiment, the material 14 is a bristled olefin material which is commonly used for indoor/outdoor carpeting. A suitable material is style no. 8806, available from Shaw Industries of Dalton, Ga. In certain embodiments, the bristled fabric 14 is formed in elongated strips. The strips of bristled material 14 are attached to the absorbant material 12 by any convenient means, such as sewing the different materials to one another.

The bristled material 14 is relatively efficient at transmitting agitating forces produced by the motion of the user's hand to the surface to be cleaned, thereby applying force to the stain in order to work the cleaning agent into the surface. Such mechanical action will act in conjunction with the chemical action of the cleaning agent to loosen and break the bond between the stain and the surface to be cleaned. It will be appreciated by those skilled in the art that other rough and/or bristled materials may be substituted for the indoor/outdoor carpet used for the bristled material 14 in the preferred embodiment.

In certain embodiments, the absorbent material 12 and rough material 14 are alternated across the face of the glove 10 in alternating bands as shown in the embodiment illustrated in FIG. 1. As shown in FIG. 1, material 14*a* has a first axis 16*a*, and material 14*b* has a second axis 16*b* that is substantially parallel to axis 16*a*. Furthermore, a band of material 14*c* having a third axis 16*c* arranged at an angle A to the second axis 16*b* is provided. In certain embodiments, the angle A is between substantially 20 degrees and 60 degrees and in other embodiments the angle A is between substantially 30 degrees and 45 degrees. Such an arrangement allows for continuous application of cleaning agent from the absorbent material 12 to the surface to be cleaned during agitation of the surface by the rough material 14. Also, the placement of the absorbent material 12 in alternating proximity to the rough material 14 allows the absorbent material 12 to absorb any dirt and excess cleaning agent from the surface to be cleaned as it is agitated. Finally, providing bands of material separated by the angle A allows a stain to be attacked from alternating angles as the glove 10 is worked over the stain. It is believed that such an arrangement of the absorbent material 12 and rough material 14 arranged in at least two bands forming an angle A between their respective axes offers a significant improvement over prior art devices, since the stain is subjected to abrasive forces in multiple directions as the glove 10 is worked over the stain.

The glove 10 of the present disclosure is ideal for hand cleaning a variety of surfaces, as it is adapted to applying a relatively large quantity of cleaning agent to the surface, will agitate the surface without scratching, and will reabsorb any excess cleaning agent. For these reasons, the glove 10 of the present invention is ideal for spot cleaning carpets, upholstered furniture, walls, vinyl wallpaper, shower walls and tile, car interiors, carpeted stairs and carpet edges and corners which cannot be reached with professional carpet cleaning equipment. Because the glove 10 of the present disclosure utilizes the rough olefin material 14 to accomplish agitation, it will not scratch delicate surfaces or ruin the pile of the carpet, as may be the case with stiff prior art brushes. The glove 10 of the present invention may be used with any cleaning agent, such as carpet shampoo, carpet spotter (for cleaning spills) or upholstery shampoo, for example. Additionally, the cloth 10 is machine washable.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. An absorbent mitten having an agitating feature to remove stain with a cleaning agent, comprising:

a base material of absorbent fleece material having an outwardly facing exterior surface;

a first elongated strip of bristled olefin material sewn to said surface of the base material and having a first axis;

a second elongated strip of bristled olefin material sewn to said surface of the base material and having a second axis; and, a third elongated strip of bristled olefin material sewn to said surface of the base material and having a third axis;

wherein said second axis and said third axis are substantially parallel; and wherein said first axis and said second axis form an angle between 30 degrees and 45 degrees; and wherein said first elongated strip, second elongated strip, and said third elongated strip are spaced apart forming with said base material adjoining, alternating areas of absorbent material and rough material to apply a cleaning agent from the areas of absorbent material to the stain as the mitten is moved over the stain.

2. The absorbent mitten of claim 1, wherein the base material comprises fleece comprising 90% polyester and 10% acrylic.

3. The absorbent mitten of claim 1, wherein the first strip, second strip and third strip comprise indoor/outdoor carpeting material having a weather resistant pile.

* * * * *